United States Patent [19]

Persson et al.

[11] Patent Number: 4,552,990

[45] Date of Patent: Nov. 12, 1985

[54] INSULATED CONDUCTOR FOR TRANSFORMER WINDINGS AND OTHER INDUCTIVE APPARATUS

[75] Inventors: Bo G. Persson; Erich Spicar, both of Ludvika, Sweden

[73] Assignee: Asea Aktiebolag, Västerås, Sweden

[21] Appl. No.: 495,727

[22] Filed: May 19, 1983

Related U.S. Application Data

[63] Continuation of Ser. No. 214,570, Dec. 8, 1980, abandoned.

[30] Foreign Application Priority Data

Dec. 11, 1979 [SE] Sweden ..... 7910171
Oct. 20, 1980 [SE] Sweden ..... 8007350

[51] Int. Cl.[4] ..... H01B 11/02

[52] U.S. Cl. ..... 174/117 FF; 174/119 R; 174/129 R; 29/605; 336/223

[58] Field of Search ..... 174/36, 117 F, 117 FF, 174/119 R, 120 C, 120 SR, 129 R, 129 B, 133 R, 133 B; 29/605, 624; 336/70, 209, 205, 206, 226; 156/204; 428/349; 427/118, 120; 310/196

[56] References Cited

U.S. PATENT DOCUMENTS

| | | | |
|---|---|---|---|
| 3,543,205 | 11/1970 | Van Nice | 174/119 R X |
| 3,723,797 | 3/1973 | Andersson et al. | 174/117 FF X |
| 3,757,029 | 9/1973 | Marshall | 174/36 |
| 3,819,443 | 6/1974 | Simons et al. | 174/117 FF X |
| 3,828,120 | 8/1974 | Hansen | 174/117 FF |
| 3,845,438 | 10/1974 | Mendelsohn et al. | 336/209 |
| 3,866,316 | 2/1975 | Takechi et al. | 29/605 |
| 4,109,375 | 8/1978 | Lin et al. | 29/605 |
| 4,159,920 | 7/1979 | Andersson et al. | 156/54 |
| 4,204,087 | 5/1980 | Lin et al. | 174/120 SR |
| 4,259,141 | 3/1981 | Andersson et al. | 156/438 |

FOREIGN PATENT DOCUMENTS

| | | |
|---|---|---|
| 2208029 | 3/1973 | Fed. Rep. of Germany . |
| 2402149 | 8/1973 | Fed. Rep. of Germany . |
| 2330786 | 1/1975 | Fed. Rep. of Germany . |
| 1076646 | 10/1954 | France . |
| 1226319 | 7/1960 | France . |
| 53-141401 | 9/1978 | Japan . |
| 141291 | 7/1976 | Norway . |
| 7604759 | 12/1977 | Sweden . |
| 720076 | 12/1954 | United Kingdom . |
| 1103764 | 2/1968 | United Kingdom . |
| 1156133 | 6/1969 | United Kingdom . |
| 1463510 | 2/1977 | United Kingdom . |

*Primary Examiner*—Volodymyr Y. Mayewsky
*Attorney, Agent, or Firm*—Watson Cole Grindle & Watson

[57] ABSTRACT

A conductor, provided with insulation for forming windings for transformers and other inductive apparatus comprises two substantially rectangular uninsulated conductor strands, which are arranged with a flat side of one conductor strand facing a flat side of the other conductor strand and with an insulating layer arranged between the flat conductor sides, of a material which forms a glued joint between the conductor strands and which contains a spacer of insulating material to ensure that the conductor strands are held at a distance from each other. The glued joint may be provided either before or after the forming of the conductor into a winding. After the glued joint has been achieved, a winding manufactured from the conductor has a high breaking strength and low additional losses. The conductor is suitable for the manufacture of complicated windings as well, such as interleaved disc windings.

11 Claims, 5 Drawing Figures

FIG. 1
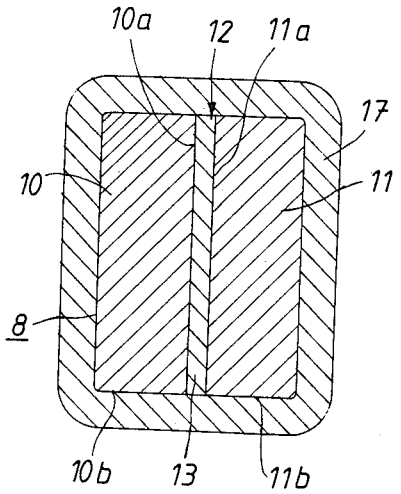
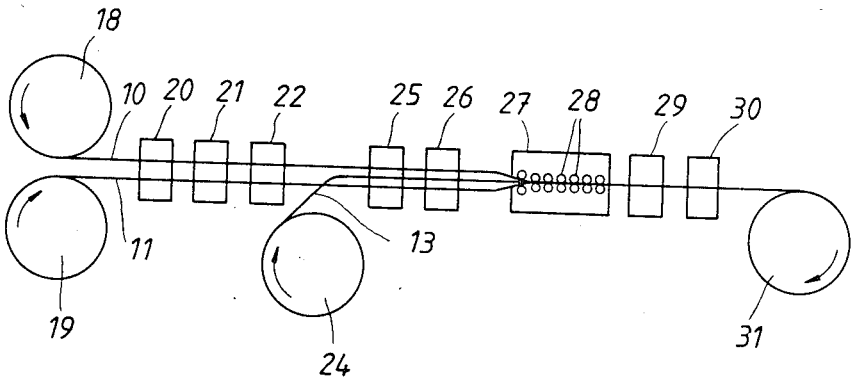
FIG. 2

FIG. 3
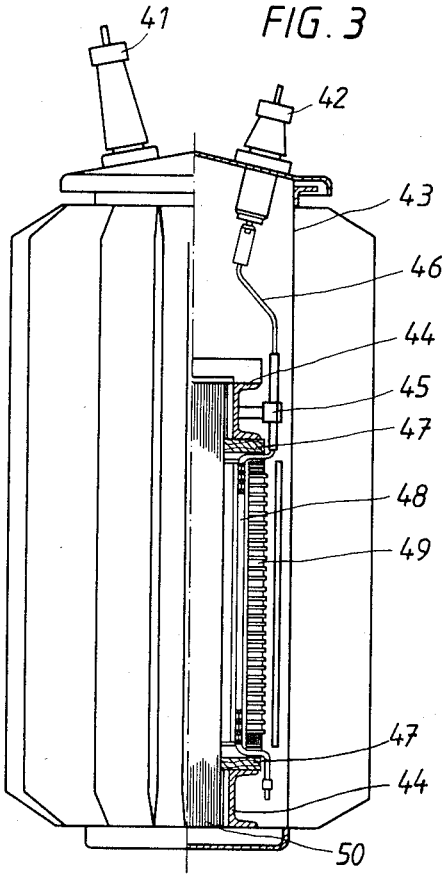
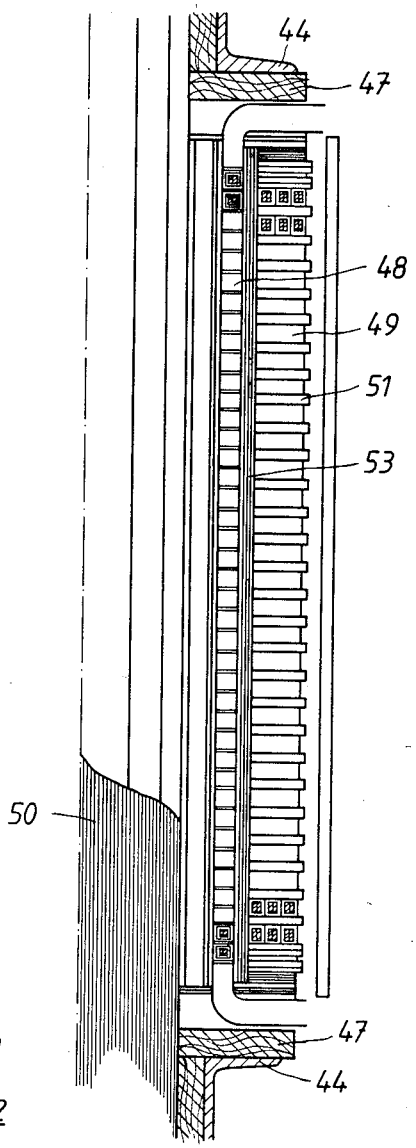
FIG. 4
FIG. 5
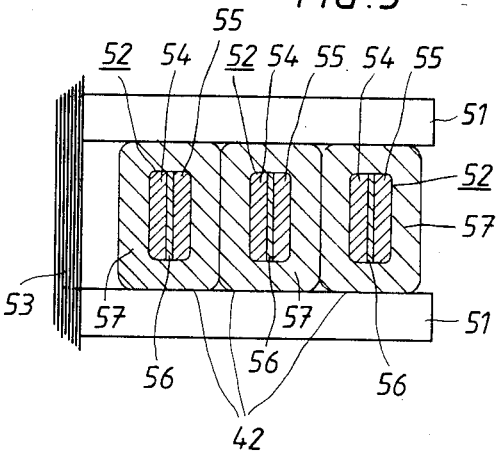

INSULATED CONDUCTOR FOR TRANSFORMER WINDINGS AND OTHER INDUCTIVE APPARATUS

This application is a continuation of application Ser. No. 214,570, filed Dec. 8, 1980 now abandoned.

BACKGROUND

1. Field of the Invention

The invention relates to insulated conductors for transformer windings and other inductive apparatus, and more particularly to such insulated conductors in which an insulator is provided between the flat sides of two conductor strands to form a glued joint therebetween with insulator spacers to maintain the conductors in spaced relationship to one another.

2. Prior Art

Upon a short-circuit in transformers, there arise forces in the windings which lead to the winding breaking, if it is not sufficiently resistive or well supported.

One way of increasing the breaking strength of a winding and therefore the resistance to short-circuit forces is to increase the thickness of the conductor which, with surrounding insulation, is used for building up the winding. Increasing the thickness of the conductor, however, results in increased additional losses and in possible problems of locally high temperatures in the winding. Additionally, the winding becomes electrically over-dimensioned and more space-demanding.

It is known to reduce the additional losses by using continuously transposed conductors when constructing transformer windings. Such conductors are built up of several varnished conductor strands having substantially rectangular shape, which within a common surrounding insulation, usually in the form of a paper wrapping, are arranged in parallel in at least two rows. Within each row one conductor strand may be arranged with a flat side facing a flat side of an adjacent conductor strand. Each varnished conductor strand may be provided with a coating of a resin, which is uncured or semi-cured so that the conductor strands are movable with respect to each other when building up a winding. The uncured or semi-cured resin is cured only when the winding has been given its final shape, usually in connection with the drying of the winding. Because of the plurality of the conductor strands and the thickness of the conductor, the conductor is difficult to wind and not possible to use for complicated windings, such as interleaved disc windings, because of the necessary transitions between one disc and an adjacent disc in such windings. Continuously transposed conductors are therefore normally used only for windings consisting of a relatively small number of turns of the conductor arranged in a layer on an insulating cylinder, and particularly for regulating windings.

SUMMARY OF THE INVENTION

According to the present invention, it is possible to achieve a conductor, by which a winding having a high breaking strength and low additional losses, may be produced and which is well suited for manufacture of complicated windings as well, such as interleaved disc windings.

The invention is based on the realization that, if the conductor is built-up of two conductor strands, it is possible to use uninsulated conductor strands, provided that an insulating layer is arranged between them which ensures that the conductor strands do not contact each other in the winding. Because the conductor only has two conductor strands, the strands maintain their original mutual positions upon bending and other similar deformations. The possibility of using uninsulated conductor strands is important from the point of view of cost in view of the very great lengths of the conductor that are used in a transformer. In addition, it gives a high space factor. According to the invention, the electrically insulating layer forms a glued joint containing spacer material in the finished winding between the conductor strands, so that the conductor, after the joining together of the conductor strands, behaves mechanically substantially as if it constituted one uniform solid conductor, which results in a high breaking strength, whereas it behaves electrically as two conductor strands insulated from each other, which results in low additional losses.

More particularly, the present invention relates to a conductor, provided with a surrounding insulation, for forming windings for transformers and other inductive apparatus, which conductor comprises two conductor strands arranged adjacent to each other and insulated from each other and having at least a substantially rectangular shape. The resultant conductor is characterized in that two uninsulated conductor strands are arranged with a flat side of one conductor strand facing a flat side of the other conductor strand and with an electrically insulating layer material, arranged between these flat sides, which forms a glue joint between the conductor strands and which contains a spacer of insulating material to ensure that the conductor strands are held at a distance from each other.

The inventive conductor also has application to other inductive apparatus such as reactors and reactor transformers.

The conductor strands are parallel-connected by being connected at the ends in a winding, manufactured from the conductor, for a transformer or a corresponding apparatus.

The insulation that surrounds the conductor may be of a conventional type and consist of a tape, wound helically with overlap, of cellulose paper or of polymer film such as a film of polyethylene glycol terephthalate, polycarbonate, polyimide, polyamideimide, polypropylene, polymethyl pentene or polysulphone. The insulation may, among other things, also consist of a wrapping of a yarn of any of the materials mentioned.

As examples of suitable materials for the material which forms the glue joint are thermosetting resins such as epoxy resins, epoxy resins modified by polyamides, urethane resins, ester resins modified by isocyanates, epoxy resins modified by urethane resins and certain rubber types (e.g. glue 4684 from Du Pont, U.S.A.) as well as thermoplastic resins such as polyethylene glycol terephthalate, polyamide and polycarbonate. The material forming the glue joint may advantageously be arranged in the form of a separate film between the electrically insulating layer and the conductor strands. It is also possible to apply the glue joint material in the form of a layer arranged on at least one of the two confronting flat sides of the conductor strands, for example, by coating one of the conductor strands with a solution of the glue joint material.

The spacer of insulating material in the material forming the glue joint (the spacer of insulating material and the glue joint forming an electrically insulating layer 12) ensures that the conductor strands are held spaced from each other and do not contact each other, especially during gluing when the material for the glue joint is liquid or soft. In spite of the fact that the conductor strands are connected together at the ends of the winding, the magnetic flux will be somewhat different so that a voltage occurs between them in operation, which necessitates an insulation between the conductors. Suitable spacers are solid film or paper, felts or fabrics of fiber material such as fibers of cellulose, polyethylene glycol terephthalate, polyamide, polyvinyl acetate, acrylo-nitrile resin, polypropylene and glass. In paper or felt material the fiber may be linked to each other, among other things, mechanically by matting together, or by melting or by an adhesive. The spacer material may be provided with through-going pores or holes, which are filled with material forming the glue joint. The papers, felts or fabrics used may advantageously be sparse. It is also possible to use as spacers, conventional fillers in powder form such as powder of chalk, mica, quartz, or aluminum oxide or conventional fibrous fillers such as fibers of cellulose, glass or other fiber materials exemplified above, for paper, felts or fabrics.

According to one embodiment of the invention, the material forming the glue joint forms the glue joint before the conductor is formed into a winding. An advantage of this embodiment is that such a conductor may be manufactured while using an efficient and controlled pressure on the conductor strands so that the glue joint between the strands at all places acquires uniform properties and the strands are efficiently fixed to each other. Such a conductor may be controlled with regard to mechanical and electrical properties before being formed into a winding. Since the conductor strands are anchored to each other in their final position, that is, so that their mutual position remains unchanged without any mutual sliding during forming of a winding and subsequent treatment, the conductor may be formed into a winding having predetermined properties without difficulty.

According to another embodiment of the invention, the glue joint is not provided until a winding has been manufactured from the conductor, that is, the conductor has been given its final shape, and then preferably in connection with the winding being dried, it is then heated sufficiently for the glue joint forming material to provide a joint between the conductor strands. Because the conductor is arranged with the flat sides of the conductor strands and the insulating layer between them arranged in all essentials in the axial direction of the winding, the outer conductor strand is stretched more than the inner conductor strand. In this way, the insulating layer in the winding will be subjected to a radial pressure, which has a favorable influence on the production of a mechanically strong joint.

BRIEF DESCRIPTION OF THE DRAWINGS

The invention is explained in greater detail by way of examples with reference to the accompanying drawings, in which:

FIG. 1 shows a cross-section of a conductor according to the present invention;

FIG. 2 schematically shows a device for manufacturing an embodiment of a conductor according to the present invention;

FIG. 3 schematically shows a power transformer comprising all parts which are fundamentally important for the present invention but which, for the sake of clarity, have been simplified so as to show only a low voltage winding and a high voltage winding with associated bushings;

FIG. 4 shows the windings on a larger scale; and

FIG. 5 shows cross-sections of conductors in the high voltage winding of a transformer with the low voltage winding made as a layer winding and the high voltage winding as a disc winding.

DETAILED DESCRIPTION OF THE PREFERRED EMBODIMENTS

In FIG. 1, two rectangular conductor strands are designated 10 and 11, respectively. A flat side 10*a* of conductor strand 10 faces a flat side 11*a* of conductor strand 11. Each conductor strand has a thickness of 2 mm and a width of the flat side of 12 mm. Between the flat sides there is arranged electrically insulating layer 12 containing spacer and glue material 13. Conductor strands 10, 11 and electrically insulating layer 12 together form conductor 8. The conductor is surrounded by wrapping 17 of helically extending paper tapes. The electrically insulating layer 12 is formed of a glue joint and spacer material (13) in the device according to FIG. 2.

With respect to FIG. 2, when manufacturing the conductor according to FIG. 1, two rectangular uninsulated conductor strands 10 and 11 of copper having a thickness of 2 mm and a width of the flat side of 12 mm, the flat sides facing each other are transported from storage rollers 18 and 19, respectively, through brake device 20 which, by friction, keeps the strands stretched during the continued treatment. Thereafter, the strands are first passed through device 21 with a plurality of deflector rolls, in which the strands are cold-worked to increase the hardness of the copper, and then through device 22 for cleaning the strands. Device 22 may consist of felt-covered nozzles or an ultrasonic bath with degreasing fluid. An 0.15 mm thick and 12 mm wide spacer 13' in the form of a sparse and very porous felt, consisting of a mixture of polyvinyl acetate fiber and polyamide fibers linked together by an acrylate binder and having a surface weight of 30 g/m$^2$ (such as Nonwoven Storalen 670-30 from Stora Kopparbergs AB, Sweden) and which is further impregnated with a polyamide-modified epoxy resin (such as AF-42 from Minnesota Mining and Manufacturing Company, U.S.A.), is transported from storage roller 24 via a number of deflector rolls (not shown) in between strands 10 and 11. Together with the material 13' spacer the strands then pass through high frequency coil 25, in which the strands are heated. When strands 10, 11 and spacer material 13' have passed through control device 26, where the strands are caused to assume the same positions in the lateral direction by means of vertical rolls, the strands enter rolling device 27 with a plurality of pairs of horizontal roll elements 28, where the strands are pressed against each other and joined together by the glue in spacer material 13 and is heated by the strands so that it cures into a glue joint. During this process, the conductor starts to be cooled and is then further cooled in cooling device 29 before the joined-together conductor passes to wrapping machine 30 where it is wrapped with paper 17 (FIG. 1). The wrapped conductor is thereafter rolled up on roller 31. It is used in a low voltage winding and with modified conductor dimensions in a high voltage winding in the transformer according to FIGS. 3 to 5.

In the transformer according to FIGS. 3–5, 41 designates a high voltage bushing, 42 a low voltage bushing, 43 the transformer tank, 44 pressure flanges, 45 an insulated support for the low voltage connection 46, 47 spacers of wood, 48 the low voltage winding, 49 the high voltage winding, 50 an iron core, 51 spacers of pressboard, 52 conductors in the high voltage winding and 53 insulating cylinders of pressboard.

The conductor in low voltage winding 48 has a cross-section as shown in FIG. 1, that is, it comprises two conductor strands 10 and 11 which are joined together by a glue joint formed by electrically insulating layer 12 comprising the spacer material and glue material 13 and is surrounded by insulation 17.

Conductors 52 in high voltage winding 49, which may be parallel-connected or series-connected, each comprises (FIG. 5) two conductor strands 54 and 55, respectively, with a thickness of 1.5 mm and a width of 10 mm on the flat side, and a glue joint, between the strands, formed of electrically insulating electrically insulating layer 56 of the same kind as layer 12, that is, including spacer material and glue material 13 (not shown in FIG. 5). Conductor insulation 57 consists of several turns of paper tape which is spirally wound with an overlap. High voltage winding 49 preferably constitutes an interleaved disc winding with a considerably greater number of conductors in each disc than the three shown in FIGS. 3–5, where a simpler winding is shown to facilitate an understanding of the Figures.

According to an alternative embodiment, electrically insulating layer 12 in the conductor according to FIG. 1 is built up of a thermosetting resin and comprises a 0.15 mm thick and 12 mm wide spacer material 13 in the form of the previously described sparse and porous felt with a surface weight of 30 g/m$^2$. The thermosetting resin, with which the spacer is impregnated, consists of an epoxy resin (such as Araldit B from Ciba, Switzerland) to which dicyandiamide as a curing agent is added, 3 parts by weight of curing agent being used per 100 parts by weight of epoxy resin. The insulating layer, which is dry, is arranged loosely between the conductor strands as a separate tape and is thus not glued to the conductor strands 10 and 11. As in the preceding case, the conductor is surrounded by wrapping 17 of helically disposed paper tape. The conductor is used in a low voltage winding and with modified dimensions (a thickness of 1.5 mm and a width of 10 mm on the flat side of each conductor strand) in a high voltage winding in the transformer according to FIGS. 3–5.

In this alternative embodiment, the glue joint is not achieved until a winding has been manufactured from the conductor. The thermosetting resins in the insulating layers 12 and 56 are then cured while forming a mechanically strong glue joint between the conductor strands when the winding is dried at about 130° C. for about twelve hours. Since the conductors in both the low voltage winding and the high voltage winding are arranged with the flat sides of the conductor strands and the insulated layer directed in the axial direction of the winding, the outer strand of the conductor becomes more stretched than the inner strand. Thus, the insulating layer is therefore subjected to a radial pressure.

In both the exemplified embodiments, transformer tank 43 is filled with transformer oil after the drying of the winding.

What is claimed is:

1. An insulated winding electrical conductor for electrically inductive apparatus, comprising:

two uninsulated, at least substantially rectangular-shaped, conductor strands positioned with a flat side of one conductor strand confronting a flat side of another conductor strand;

an electrically insulating layer being sandwiched between the flat sides of said two uninsulated conductor strands and including a solid electrically insulating spacer material for permanently maintaining said two uninsulated conductor strands in spaced relationship with one another, and having material forming a glue joint joining said electrically insulating layer and said two uninsulated conductor strands; and an insulating material surrounding the exposed surfaces of said two uninsulated conductor strands.

2. A conductor according to claim 1 wherein said material forming the glue joint is a separate film.

3. A conductor according to claim 1 wherein said material forming the glue joint is a layer arranged on at least one of the two confronting flat sides of the conductor strands.

4. A conductor according to claim 1 wherein said material forming the glue joint is heat settable.

5. A conductor according to claim 1 wherein said material forming the glue joint is settable during assembly of the conductor.

6. A conductor according to claim 1 wherein said insulating spacer consists of a perforated sheet-formed material.

7. A conductor according to claim 1 wherein said eletrically insulating spacer material includes a powdered filler contained in said material forming the glue joint.

8. A conductor according to claim 1 wherein said material forming the glue joint consists of a thermosetting resin.

9. A conductor according to claim 1 forming a winding having a substantially cylindrical shape and having the flat confronting surfaces of said two conductor strands and said insulating layer arranged in the axial direction of the winding, the insulating layer in the winding then being subjected to a radial pressure.

10. A conductor according to claim 1 wherein said insulating layer includes a fibrous filler contained in said material forming the glue joint.

11. A conductor according to claim 1 wherein insulating material surrounding the exposed surfaces of said two conductor strands is a wrapping of paper tape.

* * * * *